US005945036A

United States Patent [19]

Reitz

[11] Patent Number: 5,945,036

[45] Date of Patent: Aug. 31, 1999

[54] DUAL ENERGY DEPENDENT FLUIDS

[75] Inventor: Ronald P. Reitz, Hyattsville, Md.

[73] Assignee: The United States of America as represented by the Secretary of the Navy, Washington, D.C.

[21] Appl. No.: 07/826,207

[22] Filed: Jan. 22, 1992

Related U.S. Application Data

[63] Continuation of application No. 07/599,162, Oct. 17, 1990, abandoned, which is a continuation-in-part of application No. 07/219,523, Jul. 15, 1988, abandoned.

[51] Int. Cl.[6] ..... C10M 171/00; C10M 169/04

[52] U.S. Cl. ..... 252/572; 252/73; 252/74; 252/75

[58] Field of Search ..... 252/572, 73, 74, 252/75

[56] References Cited

U.S. PATENT DOCUMENTS

| | | | |
|---|---|---|---|
| 4,687,589 | 8/1987 | Block et al. | 252/73 |
| 4,737,886 | 4/1988 | Pedersen | 252/73 |

FOREIGN PATENT DOCUMENTS

| | | |
|---|---|---|
| 49-4270 | 1/1974 | Japan . |
| 63-97694 | 4/1988 | Japan . |
| 1178301 | 1/1970 | United Kingdom . |

OTHER PUBLICATIONS

Grant & Hackh's Chemical Dictionary, fifth edition, 1987, Definitions of "Solar Cell" and "Semiconductor".

Petizhik et al, Chem. Abs, 93, vol. 16, AN 156360y, "Electrorheological Effect in Nonaqueous Suspensions", 1980. No month available.

Omar, *Elementary Solid State Physics: Principles and Applications,* p. 300, 1975. No month available.

*Primary Examiner*—Christine Skane

*Attorney, Agent, or Firm*—Howard Kaiser

[57] ABSTRACT

A dual energy dependent electroviscous fluid which becomes electroviscous upon the application of both electric potential and a second form of energy such as light or pressure. Dual energy dependent fluids support a dipole sufficient for the fluids to become significantly electroviscous only upon exposure of the aggregate to the second form of energy simultaneous with the electric potential.

15 Claims, 1 Drawing Sheet

DUAL ENERGY DEPENDENT FLUIDS

CROSS REFERENCE TO RELATED APPLICATIONS

This application is a continuation of application Ser. No. 07/599,162, filed Oct. 17, 1990 now abandoned, which application is continuation in part of my co-pending application Ser. No. 07/219,523 filed Jul. 15, 1988 now abandoned.

BACKGROUND OF THE INVENTION

1. Field of the Invention

This invention relates to the field of electroviscous fluids and more particularly to electroviscous fluids that exhibit an effect heretofore unknown and which is herein called the Reitz effect.

2. Background Information

Electroviscous fluids refer to fluids which exhibit the property of increased viscosity when the fluid is subjected to an electric field. One phenomenon for electrically controlling the viscosity of a fluid is commonly known as the Winslow effect. As used in this disclosure, the term Winslow effect refers to the phenomenon of electrically controlling the viscosity of a fluid comprising a suspension of finely divided electrically polarizable matter in a dielectric fluid by subjecting the fluid to an electric field. Within this disclosure, the finely divided electrically polarizable matter is referred to as aggregate.

The Winslow effect as heretofore understood is practiced by placing the fluid containing the aggregate particle between spaced apart electrodes and applying a single energy source such as for example alternating or direct current between the electrodes. Even though semiconductors have been used as the aggregate material in the fluid, there is no suggestion in the prior art that it would be advantageous to use photoelectric properties attributable to semiconductors to formulate a fluid that would either cause the fluid to respond to the applied electric potential at a lesser value of such electric potential or to respond to the electric potential only after energy from a second source has been supplied.

SUMMARY OF THE INVENTION

Within the scope of the present invention is a new field of electroviscous fluids not previously shown in the prior art. These new fluids are fluids which exhibit significant electroviscous properties only upon exposure to two independent energy sources cooperating together. These fluids are referred to as fluids exhibiting the Reitz effect. Reitz effect fluids as disclosed herein differ from the Winslow effect fluids in that Reitz fluids behave electroviscously only in the presence of energy applied in a form different from the polarizing potential, such as for example, light or hydraulic pressure. The present invention, a dual energy dependent fluid comprises a dielectric fluid which is transparent to the energy which activates the aggregate, such as for example an optically translucent dielectric fluid in the case of a light activated fluid, and a multiplicity of energy activated aggregate particles dispersed in the dielectric fluid. The purpose of the second source of energy is to cause the particles to encourage or to actively generate an electric dipole on the particle independent of any dipole that may be induced on the particles by the polarizing potential normally associated with utilizing Winslow effect fluids. For this reason the fluids of the present invention are referred to as dual energy dependent electroviscous fluids. In one embodiment, exposing the aggregate particles to an energy source other than the polarizing potential causes dipoles to be actively generated on the aggregate particles. Thus, a substantial number of aggregate particles generate an electric potential such that an electric current could be extracted from the fluid were it not for the protective shield on the particles resisting particle to particle transmission of electric current. According to one embodiment of the present invention, the aggregate comprises a photovoltaic combination of a type well known in the art wherein the photovoltaic material produces electrical current upon exposure to light. It is believed that for the same aggregate count, a dual energy dependent electroviscous fluid will have a stronger particle to particle bond, thus increasing the viscosity of the fluid or solidifying the fluid at a much lower electric field potential. Suitable photovoltaic or photoelectrogenerative particles are prepared in a similar manner as for the preparation of photodiodes. Suitable particles are also prepared by comminuting photovoltaic cells, such as for example silicon solar cells, wherein small particles are obtained which retain their photovoltaic properties. A ready source for these is fallout from the manufacture of solar cells. While not desiring to be bound by theory, the generation of electrical voltages on the individual particles is believed to be the reason for a significant decrease in the applied voltage required to solidify a fluid made with photovoltaic particles. Apparently, the individual particles, when subjected to the illuminating radiation, add to the total of the polarizing potential causing less external potential to be needed.

In the case of photovoltaic particles, when light of the sensitive frequency is incident on the aggregate particle, the bonds due to accumulated charge become stronger and the viscosity of the fluid increases in the presence of an applied electrical potential. Also, when light of the sensitive frequency is not impinging on the particle, the strength of any dipole which can be induced is too weak to cause the fluid to behave significantly electroviscous. Thus, in a device using a fluid with a photovoltaic aggregate, the high voltage potential can be applied without initially causing the electroviscous effect to occur. Instead, in a device using a dual energy dependent fluid, the electroviscous nature of the fluid is changed from a less viscous state to a more viscous state by applying energy from a second source in combination with the electric field normally applied to electroviscous fluids. Removing the electric field causes the fluid to return to the less viscous state. The fluid tends to remain in the more viscous state in the presence of the electric field even when the light source is removed.

In order for fluids incorporating the Reitz effects to be effective, the core or energy dependent material of the particle are preferably shielded by use of an insulating material on the core to prevent significant particle to particle transmission of electric current. Various shielding and density matching techniques are used which are disclosed in a copending application of this inventor entitled INDUCED DIPOLE ELECTROVISCOUS FLUIDS, application Ser. No. 07/219,522, filed Jul. 15, 1988, the disclosure of which is hereby incorporated by reference. Thus, within the fluid, a substantial portion of the aggregate particles each further comprise a core and an electrically non-conductive shield, the core being at least partially electrically photocontrollable with the shield partially encompassing the core, the shield adapted to prevent particle to particle transmission of electric current. The techniques for shielding a photovoltaic core are generally the same as for other electroviscous fluids of the aforementioned application except the shield material must be optically translucent to the light frequencies to which the photocontrollable core is sensitive. The shield comprises any material that is a good electric insulator, such as for example: polyurethane elastomers, hardened epoxy adhesive, nylon, ceramic glaze, silica, silicone rubber, Teflon$^R$, glass and other good dielectric materials. For fluids dependent on forms of energy other than light, the shield material should readily transfer that form of energy to the core. The dielectric fluid comprises any dielectric fluid such as for example, dimethyl silicone oil, paraffin oil or mineral oil which is transparent to the form of energy used to activate the aggregate particles.

In a dual energy dependent fluid of the present invention which is intended to operate as a photoelectroviscous fluid, the shield which prevents significant particle to particle transmission of electric current is made to serve a dual function enabling further tailoring of the fluid to meet particular needs. When the shield completely surrounds the core so as to form a shell, the surrounding material itself is made to transmit different colors or frequencies of light. Thus, a standard core material is made which is sensitive to a broad range of light frequencies and a shield or shell material is made which attenuates a portion of the light energy as may be impinging upon the particle from a source. Thus, using the same basic core material, a family of light frequency sensitive dual energy dependent fluids can be made, each sensitive to only a portion of the entire spectrum of impinging light. A use for such a fluid is in the field of spectrum analysis.

An object of the present invention is to provide an energy dependent fluid wherein the viscosity increase of the fluid on application of a polarizing potential is intensified by the simultaneously applying a second form of energy.

Another object of the present invention is to provide an energy dependent fluid wherein the aggregate responds to an energy input to generate a portion of the polarizing potential needed to solidify the fluid.

Yet another object of the present invention is to provide an electroviscous fluid that can be tailored to respond to differing spectra of applied energy.

BRIEF DESCRIPTION OF THE DRAWINGS

In the drawings, to which reference will be made in the specification, similar reference characters have been employed to designate corresponding parts throughout the several views.

DESCRIPTION OF THE PREFERRED EMBODIMENT

Figure 1:
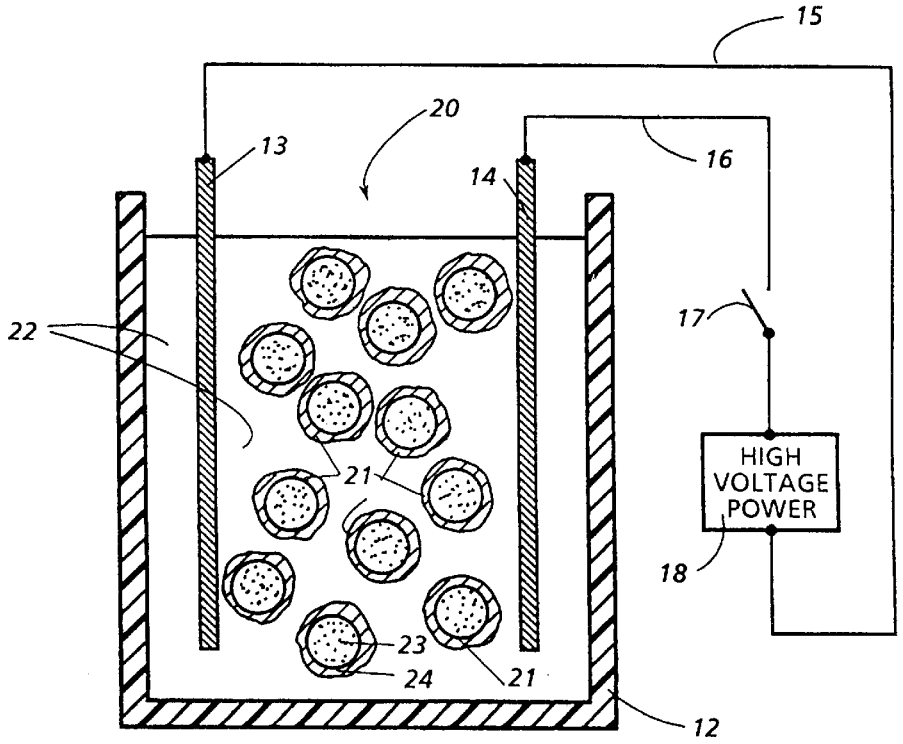
FIG. 1 is a diagrammatical representation of a dual energy dependent fluid illustrating the behavior of the fluid in the presence of electrically uncharged electrodes or in the presence of electrically charged electrodes.

Referring now to FIG. 1, a diagrammatical representation of an dual energy dependent fluid of the present invention is illustrated in an apparatus for demonstrating the dual energy dependent nature of the fluid. A reservoir for containing the fluid is illustrated schematically by glass beaker 12. Electrodes 13 and 14 are spaced apart in beaker 12 and are at least partially inserted in glass beaker 12. Electrodes 13 and 14 are made comprising any good electrical conductor material such as for example, copper, silver, aluminum, zinc, lead, steel, or bronze or any semiconductor material made comprising for example germanium or silicon. Electrodes 13 and 14 are connected through electrically conductive wires 15 and 16 through switch 17 to high voltage power supply 18. Dual energy dependent fluid 20 is in contact with electrodes 13 and 14.

Dual energy dependent fluid 20 is comprised of electrically non-conductive aggregate particles 21 substantially dispersed throughout a dielectric fluid 22. The term non-conductive when used in relation to the characteristics of the aggregate means that the separate aggregate particles are individually adapted to avoid or minimize the transmission of electrical current from one aggregate particle to another aggregate particle.

Electrically non-conductive aggregate particles 21 comprise a core 23, said core 23 being photocontrollable, and a shield 24, said shield 24 further comprising substantially non-conductive material.

Core 23 comprises any suitable material which is photocontrollable. The term photocontrollable as used herein includes both photoconductive materials and photovoltaic materials. Photoconductive materials are those elements, alloys, compositions which exhibit the property of increased electrical conductivity in the presence of light. The construction of such materials is well known in the art of electronics. Examples of suitable photoconductive material include polycrystaline indium antimonide, cadmium sulfide, cadmium sulfoselenide, lead sulfide, gallium arsenide, silicone and germanium. When photoconductive material is used as core 23, the fluid is said to be a passive dipole dual energy dependent fluid.

Alternately, core 23 comprises a photovoltaic material or combination. Photovoltaic materials are those compositions and combinations which generate an electrical potential in the presence of light. When a photovoltaic material is used as core 23, the fluid is said to be an active dipole dual energy dependent fluid. Photovoltaic materials are well known in the field of electronics. Photovoltaic materials are essentially bipolar junction diodes made from materials such as for example germanium or silicone and optimized to produce electric current upon exposure to light. One economical source of suitable core material is to grind up photovoltaic or solar cells such as the functional discards from voltaic cell production. The parts of the comminuted cells which will function as photoelectroviscous aggregate are then screened out electrically as discussed below.

Shield 24 comprises any material that is a good electric insulator, such as for example: polyurethane elastomers, hardened epoxy adhesive, nylon, ceramic glaze, silica, silicone rubber, glass and other good dielectric materials. Preferably, shield 24 encapsulates core 23 and must be translucent to the frequencies of interest. However, complete encapsulation is not necessary to the performance of either passive or active dipole photoelectroviscous fluids of the present invention. All that is necessary is for shield 24 to substantially prevent the particle to particle transmission of electric current.

Dielectric fluid 22 comprises any dielectric fluid such as for example, dimethyl silicone oil, paraffin oil or mineral oil. The particular dielectric fluid to be used in a particular application will usually require routine selection based on the anticipated end use of the dual energy dependent fluid. In photoelectroviscous fluids, the dielectric fluid must be translucent to the frequencies to which the core is sensitive.

Figure 2:
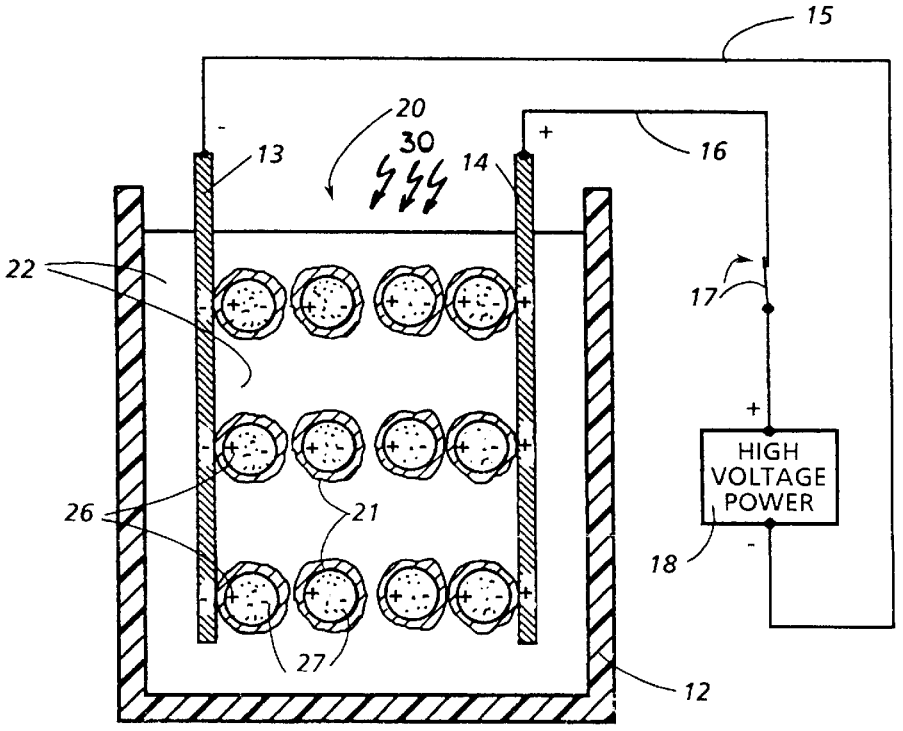
FIG. 2 is a diagrammatical representation of a dual energy dependent fluid illustrating the behavior of the fluid in the presence of electrically charged electrodes and illuminating radiation of a sensitive frequency.

Referring now to FIG. 1 and 2, the functioning of a passive dipole dual energy dependent fluid is illustrated.

With switch 17 in the open position as shown, electrodes 13 and 14 have no energizing potential applied, thus there is no electric field across dual energy dependent fluid 20. As indicated in FIG. 1, aggregate particles 21 are randomly oriented throughout dielectric fluid 22. When switch 17 is closed as in FIG. 2, electrodes 13 and 14 an electric field is permeated through dual energy dependent fluid 20 attempting to induce charges on the surface of core 23. Since in the absence of a second form of energy, core 23 is not sufficiently conductive, charges 26 and 27 have difficulty forming and the particles do not line up as shown in FIG. 2. When a second form of energy, such as for example, light source 30 is illuminated, core 23 becomes sufficiently conductive to allow charges 26 and 27 to form on the core, thus causing the particles to line up as shown in FIG. 2.

Electric charges 26 and 27 on the surface of core 23 are of opposite polarity with respect to the charges on electrodes 13 and 14 respectively. Electric charges 26 and 27 of each aggregate particle 21 cause aggregate particles 21 to align themselves along the electric lines of flux of the permeating electric field. On a fine particle dimensional scale, alignment of aggregate particles 21 gives the dual energy dependent fluid a structure which is periodic and is similar to the structure of crystalline solids. Thus, the effective viscosity of the fluid is greater under the conditions illustrated in FIG. 2 than the effective viscosity of such fluid under the conditions illustrated in FIG. 1. When electrodes 13 and 14 are electrically discharged so that they have no net charge on them, the phenomenon is reversed and dual energy dependent fluid 20 returns to the conditions illustrated in FIG. 1. Even though aggregate particles 21 may be touching, current will not be transmitted through the particles from electrode 13 to electrode 14 because shields 24 resist current transmission between cores 23.

A more pronounced Reitz effect is noted when cores 23 are made from an active material, such as for example, photovoltaic material. In the latter case, the dipole induced by the application of an electric field is supplemented by a dipole generated on the core in response to the application of light although it is believed that the dipole actively created on core 23 is stronger than a dipole merely induced in core 23 by the electric field alone.

Referring now to FIG. 1 and 2, the functioning of an active dipole dual energy dependent fluid is illustrated in a similar manner. With switch 17 in the open position as shown, electrodes 13 and 14 have no energizing potential applied, thus there is no electric field across dual energy dependent fluid 20. As indicated in FIG. 1, aggregate particles 21 are randomly oriented throughout dielectric fluid 22. When switch 17 is closed as in FIG. 2, electrodes 13 and 14 an electric field is permeated through dual energy dependent fluid 20 attempting to induce charges on the surface of core 23. Since in the absence of energy enabling the cores to produce an electric charge, cores 23 are not electrogenerative and charges 26 and 27 are not formed in abundance on cores 23 and particles 21 do not line up as shown in FIG. 2. When a second form of energy, such as for example, light source 30 is applied, cores 23 become electrogenerative (photovoltaic in the case of photovoltaic particles in the presence of light) forming an abundance of charges 26 and 27 on the core 23, thus causing the particles to line up as shown in FIG. 2.

Electric charges 26 and 27 on the surface of cores 23 are of opposite polarity with respect to the charges on electrodes 13 and 14 respectively. Electric charges 26 and 27 of each aggregate particle 21 cause aggregate particles 21 to align themselves along the electric lines of flux of the permeating electric field. On a fine particle dimensional scale, alignment of aggregate particles 21 gives the dual energy dependent fluid a structure which is periodic and is similar to the structure of crystalline solids. Thus, the effective viscosity of the fluid is greater under the conditions illustrated in FIG. 2 that the effective viscosity of such fluid under the conditions illustrated in FIG. 1. When electrodes 13 and 14 are electrically discharged so that they have no net charge on them, the phenomenon is reversed and dual energy dependent fluid 20 returns to the conditions illustrated in FIG. 1. Even though aggregate particles 21 may be touching, significant current will not be transmitted through the particles from electrode 13 to electrode 14 because shields 24 prevent current transmission between cores 23.

EXAMPLE 1

A finely ground bulk material comprising gallium arsenide, a well known photoconductive material, is encapsulated in a plastic material commercially known as Ultra Glow and obtained from ETI, Fields Landing, CA and allowed to harden into a slab. The resulting composite material is then ground and grindings or aggregate mixed with Part B of a two part adhesive identified as Duro Depend II, manufactured by Locktite Corp., Cleveland Ohio. An appropriate quantity of glass microspheres about 50 microns in diameter is mixed with Part A of the adhesive. These glass microspheres are hollow spheres of glass in which air is entrapped. These hollow spheres are available commercially from the 3M Company and have a density of less than 0.2 g/cc. The Part A mix and the Part B mix are then mixed together to form a paste. The paste is then mixed with 50 cp dimethyl silicone oil having a density of 0.98 g/cc. The paste and the silicone oil are thoroughly mixed in a blender. A clear glass container containing the fluid is placed in a darkened area and an attempt is made to collect a portion of the fluid in a probe using a high voltage probe with spaced apart electrodes having a planar surface of about 1.9 centimeters (cm) by 2.5 cm oppositely opposed at a spacing which was adjustable from about 0.32 cm to about 0.48 cm. A similar probe is described in greater detail in application Ser. No. 07/219,522. A bright light is then used to illuminate the fluid in the clear glass container. Upon application of the light, it is noted that the fluid solidifies and remains within the electrodes of the probe as the probe is withdrawn from the fluid. It is further noted that the fluid remains solidified between the electrodes even though the light source is extinguished, thus demonstrating that the fluid is photoelectroviscous.

EXAMPLE 2

A small quantity of 2.5 cm×5.0 cm silicon solar cells was purchased from a retail electronics supply source. The cells were sold by Radio Shack under the Archer$^R$ brand name as Catalog No. 276-124. Radio Shack is a Division of Tandy Corp., Ft. Worth, Tex. Using a bench grinder the solar cells were ground into small particles. The resulting ground solar cell material particles or core material was mixed with Part B of a two part adhesive identified as Duro Depend II, manufactured by Locktite Corp., Cleveland Ohio. An appropriate quantity of glass microspheres of the type more specifically described in Example 1 was mixed with Part A of the Duro Depend II two part adhesive. The Part A mix and the Part B mix were then mixed together to form a paste. The paste was then mixed with 50 cp dimethyl silicone oil having a density of 0.98 g/cc. The paste and the silicone oil were thoroughly mixed in a blender. It was observed that some of the aggregate particles had positive buoyancy, some had negative buoyancy, and others had neutral buoyancy. The clear glass container containing the fluid was placed in a darkened area and an attempt was made to collect a portion of the fluid in a high voltage probe having a spacing ranging from 0.32 cm to 0.48 and opposed surface areas of about 1.8 $cm^2$. With the electrode spacing at about 0.32 cm, it was noted that the fluid did not solidify even at a potential of up to about 3000 volts (about 1000 volts/mm). A bright light from a desk lamp was then used to illuminate the fluid which was in the clear glass container. Upon application of the light, it was noted that the fluid solidified and remained within the electrodes of the probe as the probe was withdrawn from the fluid, thus demonstrating that the fluid is dual energy dependent or in this case photoelectroviscous. It was further noted that the fluid remained solidified between the electrodes even though the light source was extinguished. Solidification occurred at an electrode potential of about 2000 volts (about 625 volts/mm).

Other embodiments of the invention will be apparent to the skilled in the art from a consideration of this specification or practice of the invention disclosed herein. It is expected that fluids dependent on other dual forms of energy are also realizable, such as for example piezoelectric particles in combination with hydraulic pressure, thermoelectric particles in combination with thermal energy and Hall effect devices in combination with magnetic energy. A suitable composition for core of piezoelectric particles is comminuted piezoelectric crystal material PZT-5 taken from transducers available from the Vernitron Corp. Piezoelectric Div. located in Bedford, Ohio. A suitable shield material for piezoelectric particles is RTV 108 silicone rubber manufactured By General Electric Co., Waterford, N.Y. It is intended that the specification and examples be considered as exemplary only, with the true scope and spirit of the invention being indicated by the following claims.

What is claimed is:

1. A dual energy dependent electroviscous fluid, comprising:

a dielectric liquid; and a multiplicity of aggregate particles dispersed in said dielectric liquid;

substantial numbers of said aggregate particles each including a photovoltaic core and a dielectric shield;

said dielectric shield at least partially encapsulating said photovoltaic core;

said photovoltaic core including bipolar junction diode material which generates an electric potential in the presence of light;

whereby said electroviscous fluid has an electroviscous response upon exposure of at least some said photovoltaic cores to light and to an externally applied electric field.

2. A dual energy dependent electroviscous fluid as claimed in claim 1, wherein said dielectric shield includes an electric insulator selected from the group consisting of polyurethane, epoxy adhesive, nylon, ceramic glaze, silica, silicone rubber and glass.

3. A dual energy dependent electroviscous fluid as claimed in claim 2, wherein said bipolar junction diode material includes material which is selected from the group consisting of silicon and germanium.

4. A dual energy dependent electroviscous fluid as claimed in claim 1, wherein said photovoltaic core includes a photodiode.

5. A dual energy dependent electroviscous fluid as claimed in claim 4, wherein said photodiode is a fragment of a solar cell.

6. A dual energy dependent electroviscous fluid as claimed in claim 1, wherein said dielectric shield includes at least one buoyant body.

7. A dual energy dependent electroviscous fluid as claimed in claim 6, wherein at least one said buoyant body is a gas pocket formed in said dielectric shield.

8. A dual energy dependent electroviscous fluid as claimed in claim 6, wherein at least one said buoyant body is a hollow glass microsphere.

9. A dual energy dependent electroviscous fluid as claimed in claim 8, wherein said microsphere has a density of about 0.2 grams per cubic centimeter.

10. A dual energy dependent electroviscous fluid as claimed in claim 6, wherein at least one said buoyant body is a hollow plastic form.

11. A dual energy dependent electroviscous fluid as claimed in claim 6, wherein at least one said buoyant body is affixedly attached to said photovoltaic core using an adhesive.

12. A dual energy dependent electroviscous fluid as claimed in claim 1, wherein said bipolar junction diode material includes material which is selected from the group consisting of silicon and germanium.

13. An electroviscous fluid, comprising:

a composition mixture of dielectric fluid and a multiplicity of particles dispersed in said dielectric fluid;

substantial numbers of said particles each including an electrogenerative core at least partially encapsulated by a dielectric shield;

said electrogenerative core including bipolar junction diode material and being responsive to light, thereby generating an electric potential;

said dielectic shield including an electic insulator.

14. An electroviscous fluid, comprising:

a dielectric fluid means selected from the group consisting of silicone oil, paraffin oil and mineral oil; and a multiplicity of particles dispersed within said dielectric fluid means;

each of said particles including a fragment of a solar cell, said fragment including bipolar junction diode material;

each said fragment being at least partially encapsulated by an electric insulator.

15. An electroviscous fluid as claimed in claim 14, wherein said electric insulator includes at least one buoyant body.

* * * * *